US011721895B2

(12) United States Patent
Hwang et al.

(10) Patent No.: US 11,721,895 B2
(45) Date of Patent: Aug. 8, 2023

(54) ANTENNA ARRAY CALIBRATION DEVICE AND METHOD THEREOF

(71) Applicant: INDUSTRIAL TECHNOLOGY RESEARCH INSTITUTE, Hsinchu (TW)

(72) Inventors: Ruey-Bing Hwang, Hsinchu (TW); Yueh-Lin Tsai, Yunlin County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 98 days.

(21) Appl. No.: 17/553,500

(22) Filed: Dec. 16, 2021

(65) Prior Publication Data

US 2023/0143739 A1 May 11, 2023

(30) Foreign Application Priority Data

Nov. 10, 2021 (TW) ..... 110141779

(51) Int. Cl.
*H01Q 3/26* (2006.01)
*H01Q 3/30* (2006.01)
*H01Q 21/22* (2006.01)

(52) U.S. Cl.
CPC ..... *H01Q 3/267* (2013.01); *H01Q 3/30* (2013.01); *H01Q 21/22* (2013.01)

(58) Field of Classification Search
CPC ..... H01Q 3/267; H04B 17/12
See application file for complete search history.

(56) References Cited

U.S. PATENT DOCUMENTS 6,208,287 B1 3/2001 Sikina et al.
6,686,873 B2 * 2/2004 Patel ..... H01Q 3/267 342/368

(Continued)

FOREIGN PATENT DOCUMENTS

CN 101119357 A 2/2008
CN 107342827 A 11/2017

(Continued)

OTHER PUBLICATIONS

Taiwan Office Action dated Mar. 31, 2022 as received in application No. 110141779.

(Continued)

*Primary Examiner* — Daniel Munoz
(74) *Attorney, Agent, or Firm* — Maschoff Brennan

(57) ABSTRACT

An antenna array calibration device and method thereof are provided. The method includes measuring the power total of the antenna array, controlling active components to adjust the antennas to having a maximum amplitude, controlling phase shifters to adjust the antennas to having a random phase, calculating the phase difference between an initial phase and a random phase, calculating the amplitude difference between an initial amplitude and the maximum amplitude, introducing the phase difference, the amplitude difference and the power total of the antenna array into a simultaneous equation of amplitudes and phases to obtain the initial amplitude and the initial phase of the antennas, and adjusting the phase of the antenna array if there is a real number solution of the equation, or otherwise adjusting the phase of the antenna array to another random phase to obtain a real number solution of the equation.

10 Claims, 7 Drawing Sheets

(56) References Cited

U.S. PATENT DOCUMENTS

| | | | | |
|---|---|---|---|---|
| 6,771,216 | B2 | 8/2004 | Patel et al. | |
| 7,881,402 | B2 | 2/2011 | Gao et al. | |
| 7,911,376 | B2 | 3/2011 | Hardacker et al. | |
| 10,211,527 | B2 | 2/2019 | Safavi-Naeini et al. | |
| 10,310,064 | B2 | 6/2019 | Majumdar et al. | |
| 10,574,432 | B2 | 2/2020 | Banu et al. | |
| 11,005,581 | B1 | 5/2021 | Gomadam et al. | |
| 11,476,575 | B2 * | 10/2022 | Laria | H04B 7/18517 |
| 11,575,459 | B2 * | 2/2023 | Fan | H04B 17/12 |
| 2018/0115064 | A1 | 4/2018 | Safavi-Naeini et al. | |

FOREIGN PATENT DOCUMENTS

| | | | |
|---|---|---|---|
| CN | 112737708 | A | 4/2021 |
| TW | 201810980 | | 3/2018 |
| TW | 201909038 | A | 3/2019 |
| WO | 2018/037112 | A1 | 3/2018 |

OTHER PUBLICATIONS

Zhang Lu, et al., "Amplitude and phase correction of the phased array antenna by REV algorithm," 2017 2ND International Conference on Image, Vision and Computing (ICIVC), IEEE, pp. 913-917 (Jun. 2, 2017).

Extended European Search Report dated Jun. 27, 2022 as received in Application No. 21216486.7.

Aumann, et al., "Phased Array Antenna Calibration and Pattern Prediction Using Mutual Coupling Measurements," IEEE Transactions on Antennas and Propagation, vol. 37, Issue 7, pp. 844-850 (Jul. 1989).

Gupta, et al., "An Experimental Study of Antenna Array Calibration," IEEE Transactions on Antennas and Propagation, vol. 51, Issue 3, pp. 664-667 (Mar. 2003).

Takahashi, et al., "Fast Measurement Technique for Phased Array Calibration," IEEE Transactions on Antennas and Propagation, vol. 56, Issue 7, pp. 1888-1899 (Jul. 2008).

Schmid, et al., "On the Effects of Calibration Errors and Mutual Coupling on the Beam Pattern of an Antenna Array," IEEE Transactions on Antennas and Propagation, vol. 61, Issue 8, pp. 4063-4072 (Aug. 2013).

Korotetskiy, et al., "Phased Array Antenna Calibration with Probe Positioning Errors," IEEE Antennas & Propagation Magazine, vol. 58, Issue 3, pp. 65-80 (Jun. 2016).

He, et al., "Fast Phased Array Calibration by Power-Only Measurements Twice for Each Antenna Element," International Journal of Antennas and Propagation, vol. 2019, pp. 1-11 (2019).

* cited by examiner

ANTENNA ARRAY CALIBRATION DEVICE AND METHOD THEREOF

CROSS-REFERENCE TO RELATED APPLICATIONS

This non-provisional application claims priority under 35 U.S.C. § 119(a) on Patent Application No(s). 110141779 filed in Republic of China (Taiwan) on 2021 Nov. 10, the entire contents of which are hereby incorporated by reference.

BACKGROUND

1. Technical Field

The present invention relates to the field of antenna array calibration device and method thereof, and more particularly, to an antenna array calibration device and method thereof capable of using both phase rotation and amplitude attenuation to achieve fast calibration.

2. Related Art

In modern days, phased array antennas are indispensable technologies in mobile communications, satellite communications systems, and military radar systems. To achieve accurate beam forming, the vector electric field (which includes both the amplitude and phase) of each radiating element of the array antenna must be accurately controlled. However, due to the amplitude and phase of each radio frequency (RF) path cannot in perfect consistency, the initial amplitudes and initial phases of the phase shifters being equivalent to random variables, the existence of the electromagnetic couple between antennas, etc., the amplitude and phase of each radiating antenna present in a random manner. Therefore, how to utilize the electromagnetic theory and power measurement in order to accurately obtain the initial amplitude and phase of each radiation source remains an issue to be studied in the field calibrating phased array antenna systems.

Most of the existing literatures and current methods use the Rotating Element Electric Field Vector (REV) method for phase compensation. However, since the Rotating Element Electric Field Vector method must adjust each phase shifter and measure the variation of power total of all antennas in an antenna array at the same time, the measurement session is agonizingly long and seems unrealistic to phased array systems under a changeable operating environment that require intensive calibrations.

SUMMARY

According to the above, an embodiment of the present invention, an antenna array calibration device, applied to an antenna array comprising a plurality of antennas, the antenna array calibration device comprises: a processor, configured to analyze and calculate whether is a real number solution of a simultaneous equation of amplitudes and phases; and a controller, configured to adjust the antennas from having an initial phase to having a random phase, and adjust the antennas from having an initial amplitude to having a maximum amplitude; wherein the processor calculates a phase difference by subtracting one of the initial phase and the random phase from the other, calculates an amplitude difference by subtracting one of the initial amplitude and the maximum amplitude from the other, and introduces the phase difference, the amplitude difference and a power total of the antenna array into the simultaneous equation of amplitudes and phases; if there is a real number solution for the simultaneous equation of amplitudes and phases, the controller obtains initial amplitudes and initial phases of the antennas to calibrate the phase of the antenna array; and if there is no real number solution for the simultaneous equation of amplitudes and phases, the controller adjusts the antennas to having another random phase different from the random phase, and the processor recalculates the simultaneous equation of amplitudes and phases according to the other random phase in order to obtain a real number solution.

According to another embodiment of the present invention, an antenna array calibration method, applied to an antenna array, wherein the antenna array is composed of a plurality of antennas, a plurality of phase shifters and a plurality of active components, each of the antennas is coupled to a corresponding phase shifter among the phase shifters and to a corresponding active component among the active components, and the antenna array calibration method comprises: measuring a power total of the antenna array; controlling the active components to adjust the antennas from having an initial amplitude to having a maximum amplitude; controlling the phase shifters to adjust the antennas from having an initial phase to having a random phase; calculating a phase difference by subtracting one of the initial phase and the random phase from the other, calculating an amplitude by subtracting one of the initial amplitude and the maximum amplitude from the other, introducing the phase difference, the amplitude difference and the power total of the antenna array into a simultaneous equation of amplitudes and phases in order to calculate whether there is a real number solution for the simultaneous equation of amplitudes and phases; if there is a real number solution for the simultaneous equation of amplitudes and phases, obtaining initial amplitudes and initial phases of the antennas to calibrate the phase of the antenna array; and if there is no real number solution for the simultaneous equation of amplitudes and phases, controlling the phase shifters to adjust the antennas to having another random phase different from the random phase, and recalculating the simultaneous equation of amplitudes and phases according to the other random phase in order to obtain a real number solution.

DETAILED DESCRIPTION

The phased array is based on the linear superposition principle, where the radiation electric field of an antenna array system can be formed by superposing multiple electric fields of each antenna. However, due to the initial phase and the initial amplitude of each radio frequency (RF) path not in consistency as well as the coupling effect between antennas, the difference between the initial electric fields at one end of the antennas is driven large. The objective of the present invention uses mathematical methods to calculate the initial electric field of each antenna of the antenna array, and thereby uses a phase adjustable phase shifter and an amplitude adjustable attenuator to compensate for the difference between the initial electric fields.

Because the radiation electric field is a complex number, it has two variables: phase and amplitude. The two variables must be solved using two equations to obtain a simultaneous solution of a simultaneous equation of amplitudes and phases. The phase shifter is used to adjust the phase, which can provide a leading phase or a lagged phase. The attenuator is used to adjust the amplitude, which can generate an amplified amplitude or attenuated amplitude. For example, the attenuator can achieve amplification or attenuation according to different attenuation factors.

Figure 1:
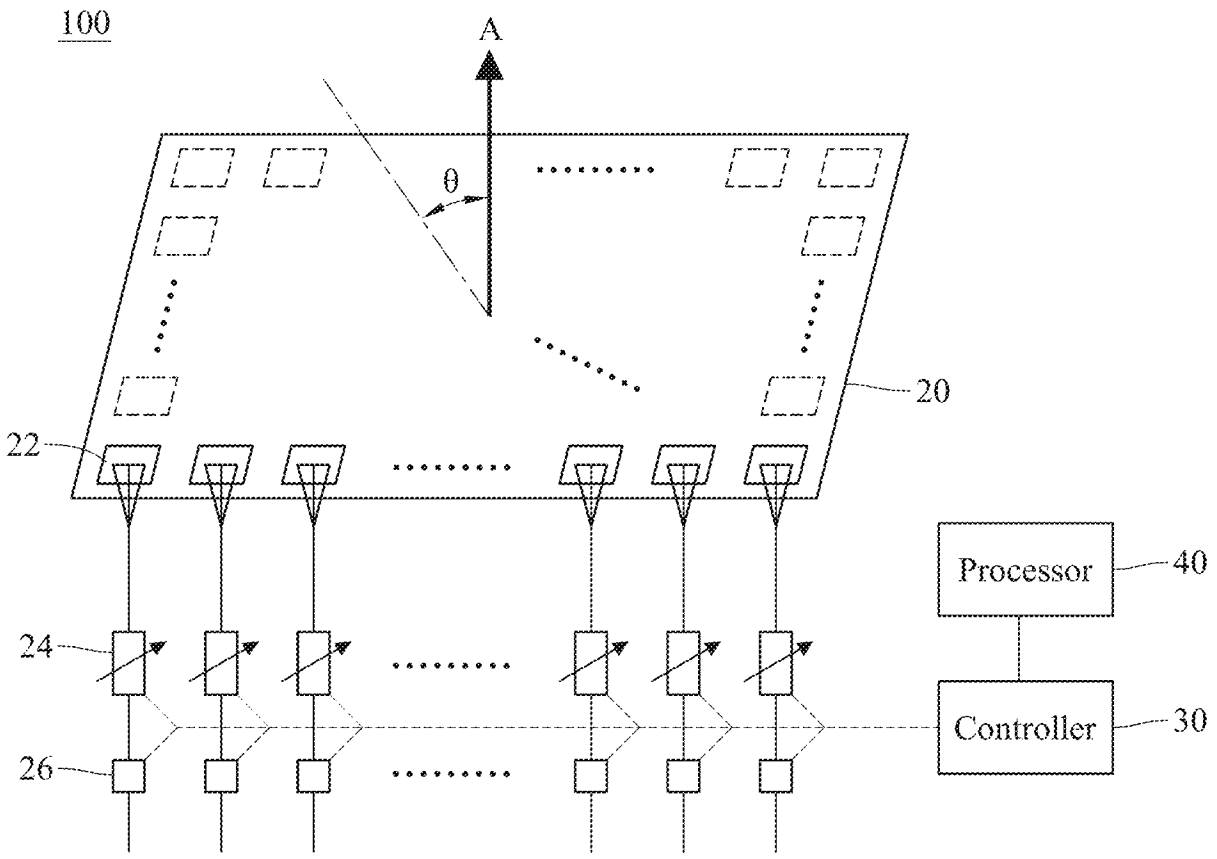
FIG. 1 is a schematic view of an antenna array calibration device according to an embodiment of the present invention.
Figure 2:
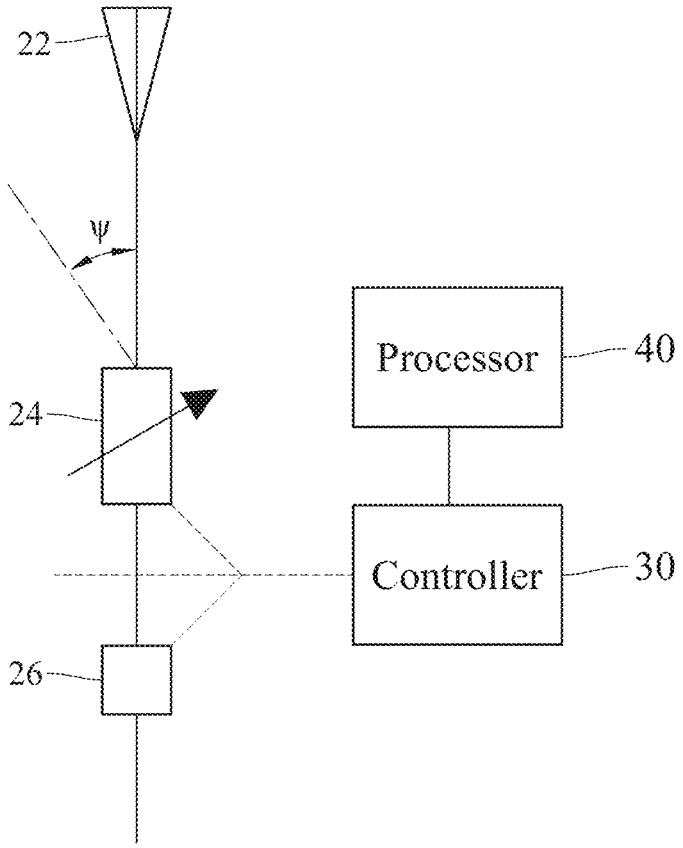
FIG. 2 is a zoomed-in view of the antenna array calibration device according to an embodiment of the present invention.

Refer to FIG. 1 and FIG. 2. FIG. 1 is a schematic view of an antenna array calibration device 100 according to an embodiment of the present invention, and FIG. 2 is a zoomed-in view of the antenna array calibration device 100 according to an embodiment of the present invention.

In an embodiment, as illustrated in FIG. 1, the antenna array calibration device 100 is applied to an antenna array 20. The antenna array 20 comprises a plurality of antennas 22, and the antenna array calibration device 100 comprises a controller 30 and a processor 40.

In some embodiments, the antennas 22 can be one-dimensionally or two-dimensionally arranged in the antenna array 20, but the present invention does not limit the dimension of the antennas 22 of the antenna array 20 to be arranged in particular ways. For example, the technical means of the present invention can also be applied to a three-dimensional structure. In some embodiments, the antenna array 20 of the present disclosure can be implemented as a single set or multiple sets in a communication device. The communication device can be a mobile communication device, a mobile computing device, a computer device, a telecommunication device, a base station device, a wireless bridge device, a network equipment, a computer or network peripherals, etc. In some embodiments, the antenna array calibration device 100 can comprise one or more antenna arrays 20, and the number of antennas 22 assigned to an antenna array 20 depends on actual design requirements. For example, the antenna array 20 shown in FIG. 1 can be composed of M×N antennas 22, wherein both M and N are positive integers. In some embodiments, the antenna array 20 can be composed of 256 (16×16) antennas 22.

The controller 30 is configured to adjust each antenna 22 from having an initial phase to having a random phase, and adjust the antennas 22 from having an initial amplitude to having a maximum amplitude.

In an embodiment, the antenna array calibration device 100 may comprise a plurality of phase shifters 24 and a plurality of active elements 26. In some embodiments, each antenna 22 can be coupled to a corresponding one of the phase shifters 24 and a corresponding one of the active elements 26. For example, the embodiment of FIG. 1 illustrates that each phase shifter 24 is coupled between a corresponding antenna 22 and active element 26, while other embodiments may instead arrange each active element 26 to be coupled between a corresponding antenna 22 and phase shifter 24. In some embodiments, the active elements 26 can be implemented with at least one of digital attenuators, analog attenuators, operational amplifiers and variable gain amplifiers (VGA). In some embodiments, in addition to the phase shifters 24 and the active elements 26, each antenna 22 can be coupled to one or more elements, such as a driver, a detector, a splitter (beam splitter), a temperature controller, a filter, a converter, a rectifier, a digital-to-analog converter, an another phase shifter, an another active component, a chip, a circuit, or a feedback circuit, etc. The above chip or the above circuit may be, for example, an electronic circuit, an integrated circuit, a microchip, and an active/passive semiconductor component, etc.

In an embodiment, each antenna 22 can be used to transmit or receive signals, such as radio frequency (RF) signals. In some embodiments, each antenna 22 can handle a single signal beam or multiple signal beams. In some embodiments, the antenna array 20 can control a phase shifter 24 of each antenna 22 through the controller 30 in order to adjust the phase of each antenna 22. For example, the controller 30 controls the antennas 22 to adjust from having the initial phase to having a random phase. In some embodiments, the phase variation (i.e. the phase difference) between the random phase and the initial phase can be in any angle, such as 1 degree, 10 degrees, 15 degrees, 45 degrees, or 90 degrees.

In an embodiment, the antenna array 20 can control an active element 26 of each antenna 22 through the controller 30 in order to adjust the amplitude of each antenna 22. For example, the controller 30 adjusts the antennas 22 to from having the initial amplitude to having a maximum amplitude.

The processor 40 is configured to analyze and calculate whether there is a real number solution for a simultaneous equation of amplitudes and phases. In some embodiments, the processor 40 may be a device capable of executing coded arithmetic, logic, and/or I/O operating commands. In some embodiments, the processor 40 can comprise an arithmetic logic unit (ALU), a control unit, and/or a register, wherein the above register can be any type of fixed or removable random access memory (RAM), read-only memory (ROM), flash memory, hard disk drive (HDD), solid state drive (SSD), similar elements or a combination of the above elements. In some embodiments, the processor 40 and the controller 30 can be integrated in a same chip or container. In some embodiments, the antenna array calibration device 100 may comprise one or more processors 40. In some embodiments, the processor 40 is a single-core processor capable of executing one command each time (or executing a single command pipeline), or a multi-core processor capable of executing multiple commands at the same time. In some embodiments, the processor 40 may be one or more integrated circuits. In some embodiments, the processor 40 may be a central processing unit (CPU), other programmable general-purpose or special-purpose microprocessors, a digital signal processor (DSP), a programmable controller, an application specific integrated circuit (ASIC), other similar components or a combination of any of the above components, but the disclosure is not limited to the embodiments. In some embodiments, the processor 40 may comprise an interconnection or transmission function, such as a wireless network function or a local area network function.

In some embodiments, the above simultaneous equation of amplitudes and phases can be expressed by the following Equation 1 and Equation 2:

$$\left(X_n + \frac{\sqrt{P_\alpha}}{1-\alpha}\right)^2 + Y_n^2 = \left(\frac{\sqrt{P_0}}{1-\alpha}\right)^2 \quad \text{Equation 1}$$

$$\left(X_n + \frac{\sqrt{P_\alpha}(\cos\psi - \alpha)}{\alpha^2 - 2\alpha\cos\psi + 1}\right)^2 + \left(y_n + \frac{\sqrt{P_\alpha}\sin\psi}{\alpha^2 - 2\alpha\cos\psi + 1}\right)^2 = \left(\frac{\sqrt{P_\Phi}}{\alpha^2 - 2\alpha\cos\psi + 1}\right)^2 \quad \text{Equation 2}$$

wherein the parameter $P_\alpha$ in Equation 1 and Equation 2 denotes the power total (in linear coordinates) of the nth antenna 22 of the antenna array 20 with the amplitude being adjusted by $\alpha$ (e.g. amplified or attenuated by $\alpha$), the parameter $P_0$ denotes the power total of the antenna array 20 under an initial state, and the parameter $P_\Phi$ denotes the power total of the nth antenna of the antenna array 20 with the phase being adjusted by $\psi$.

The variables $X_n$ and $Y_n$ in Equation 1 and Equation 2 are unknown variables that need to be calculated, and can be expressed by the following Equation 3 and Equation 4:

$$X_n = |E_n| \cos \psi_n \quad \text{Equation 3}$$

$$Y_n = |E_n| \sin \psi_n \quad \text{Equation 4}$$

wherein the parameter $E_n$ and $\phi_n$ in Equation 3 and Equation 4 are the initial amplitude and the initial phase of the nth antenna 22 in the antenna array 20, respectively.

In an embodiment, as illustrated in FIG. 2, the processor 40 may calculate a phase difference according to the adjustment from the initial phase to the random phase (e.g. the phase shifting angle $\psi$ shown in FIG. 2). For example, the phase difference may be calculated by subtracting one of the initial phase and the random phase from the other. In addition, the processor 40 may calculate the above-mentioned amplitude difference according to the adjustment from the initial amplitude to the maximum amplitude. For example, the amplitude difference may be calculated by subtracting one of the initial amplitude and the maximum amplitude from the other. The processor 40 introduces the above-mentioned phase difference, the above-mentioned amplitude difference and the power total of the antenna array 20 into the above-mentioned simultaneous equation of amplitudes and phases, to obtain a real number solution.

If there is a real number solution in the above-mentioned simultaneous equation of amplitudes and phases, meaning that the initial amplitude $E_n$ and the initial phase $\psi_n$ of each antenna 22 can be generated. The controller 30 can calibrate the phase of the antenna array 20 according to the calculation of the above-mentioned initial amplitude and the above-mentioned initial phase of each antenna 22, and perform phase compensation to make the main beam A of the antenna array 20 (see FIG. 1 and FIG. 6) reach a predetermined target angle, such as the calibrated angle $\theta$ shown in FIG. 1.

If there is no real number solution in the above-mentioned simultaneous equation of amplitudes and phases, the controller 30 will again control the antennas 22 to adjust to having another random phase that is different from the above-mentioned random phase, and the processor 40 recalculates the above simultaneous equation of amplitudes and phases to obtain a real number solution according to the above-mentioned another random phase. In some embodiments, for example, the phase difference between two consecutive random phases can be fixed to 1 degree, 10 degrees, 15 degrees, 45 degrees, or 90 degrees. In some embodiments, the present invention requires can obtain the real number solution by merely using the controller 30 to adjust the phase variation for one time and adjust the amplitude variation for one time to obtain the initial phase and the initial amplitude of an antenna 22. For example, to solve the above simultaneous equation of amplitudes and phases using the antenna array 20 composed of 256 (16×16) antennas 22 implemented in the present invention, it requires merely 512 (256×2) phase modulations and power measurements. That is, it takes only 512 phase modulations to complete the phase calibration of the antenna array 20.

Figure 3:
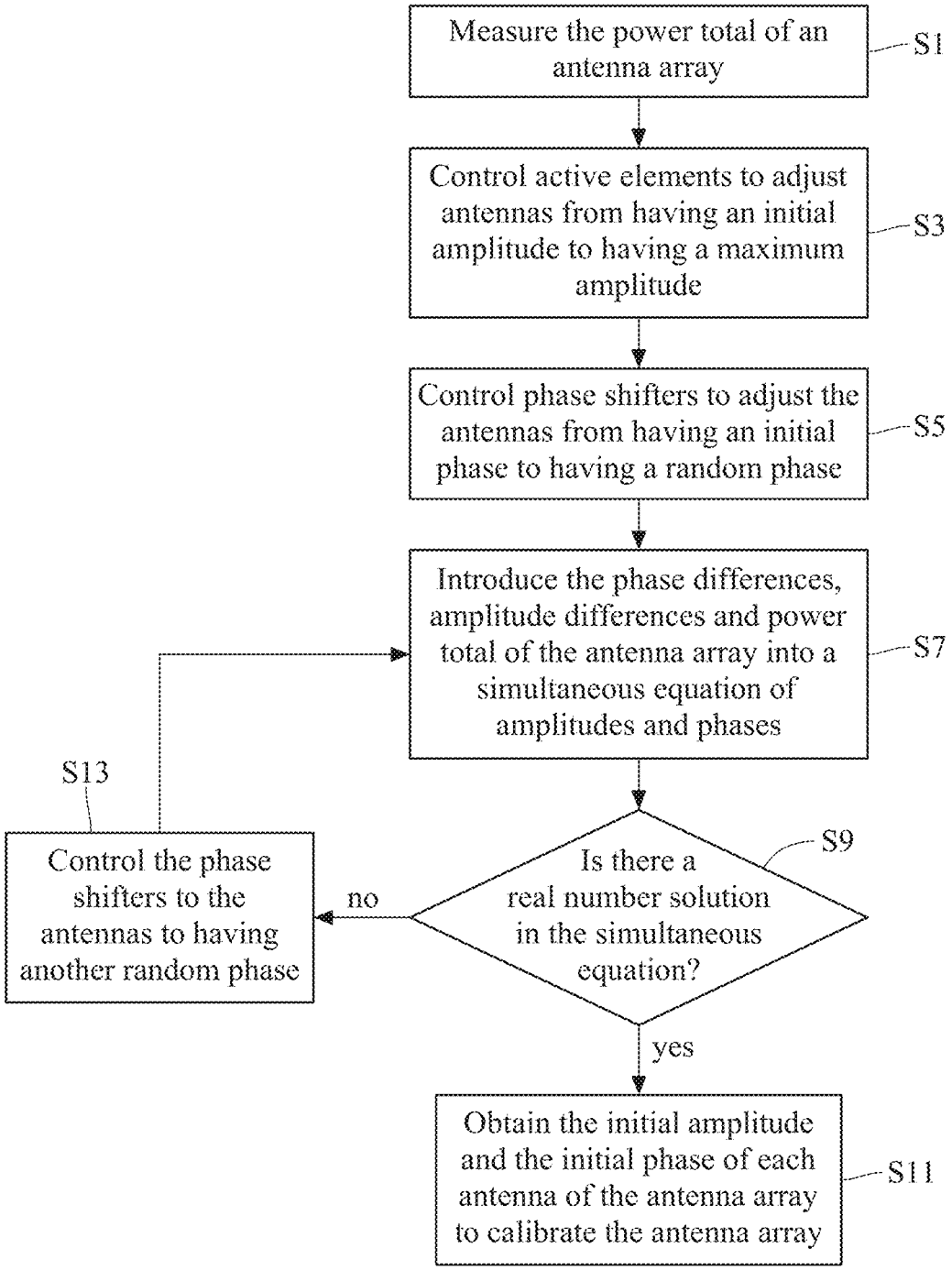
FIG. 3 is a flow chart of an antenna array calibration method according to an embodiment of the present invention.

Refer to FIG. 3, FIG. 3 is a flow chart of an antenna array calibration method according to an embodiment of the present invention.

In an embodiment, as illustrated in Step S1 of FIG. 3, a processor 40 measures the power total of an antenna array 20.

In Step S3, a controller 30 controls the active elements 26 to adjust the antennas 22 from having an initial amplitude to having a maximum amplitude.

In Step S5, the controller 30 controls the phase shifters 24 to adjust the antennas 22 from having an initial phase to having a random phase.

In Step S7, the processor 40 calculates a phase difference by subtracting one of the above-mentioned initial phase and the above-mentioned random phase from the other, and the processor 40 calculates an amplitude difference by subtracting one of the above-mentioned initial amplitude and the above-mentioned maximum amplitude from the other. The processor 40 introduces the above-mentioned phase difference, the above-mentioned amplitude difference and the power total of the antenna array 20 into the above-mentioned simultaneous equation of amplitudes and phases. In Step S9, the processor 40 determines whether there is a real number solution in the above-mentioned simultaneous equation of amplitudes and phases.

In Step S11, if there is a real number solution in the above-mentioned simultaneous equation of amplitudes and phases, the processor 40 will obtain the above-mentioned initial amplitude and initial phase of the antenna array 20, and the controller 30 will perform phase compensation to calibrate the antenna array 20 according to the above-mentioned initial amplitude and the above-mentioned initial phase.

In Step S13, if there is no real number solution in the above-mentioned simultaneous equation of amplitudes and phases, the controller 30 will again control the phase shifters 24 to adjust the antennas 22 of the antenna array 20 from having the random phase to having another random phase, and the processor 40 will recalculate the above-mentioned simultaneous equation of amplitudes and phases until a real number solution is generated.

Figure 4:
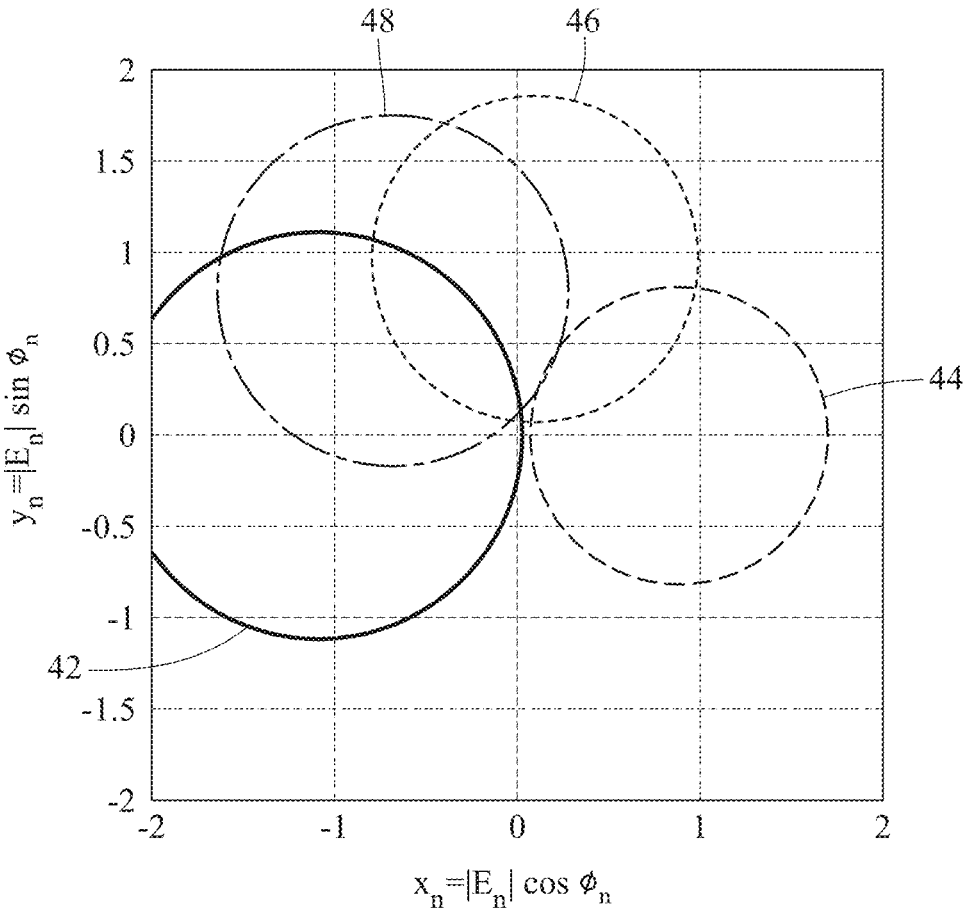
FIG. 4 is a schematic view of the power circle generated by the simultaneous equation of amplitudes and phases according to the present invention.

Refer to FIG. 4, FIG. 4 is a schematic view of the power circle generated by the simultaneous equation of amplitudes and phases according to the present invention.

In an embodiment, as illustrated in FIG. 4, because the above-mentioned initial phase and the above-mentioned initial amplitude of the antennas 22 cannot be estimated (a random distribution), in the linear coordinate system of the variable $X_n$ as the X-axis and variable $Y_n$ as the Y-axis according to the above-mentioned simultaneous equation of amplitudes and phases, a first power circle 42 can be obtained after an amplitude adjustment (amplification or attenuation) $\alpha$ by the Equation 1, and a second power circle 44, a third power circle 46 and a fourth power circle 48 can be obtained after phase shifting angle $\psi_1$, $\psi_2$, and $\psi_3$ respectively by the Equation 2.

When angles are adjusted to different angles (e.g. $\psi_1$, $\psi_2$, $\psi_3$) and the power total obtained by modulating the phase is less than the power total obtained by modulating the attenuation, improper phase shifting angles (e.g. $\psi_1$) will result in real number solution not existed, e.g., the first power circle 42 and the second power circle 44 have no intersection point (no real number solution). Appropriate phase shifting angles (e.g. $\psi_2$, $\psi_3$), however, will result in a real number solution existed, e.g., the first power circle 42 intersects with and the third power circle 46 and the fourth power circle 48 and therefore have two intersection points, in which intersection points indicate that there is a real number solution. Therefore, the present invention provides to change the phase shift angle $\psi$ of the antennas 22 according to any random phase (see FIG. 2), which is to change the center point of the power circle converted by Equation 2, in order to obtain a real number solution. In some embodiments, the present invention may continuously generate random phases to generate different power circles until a real number solution is generated.

Figure 5A:
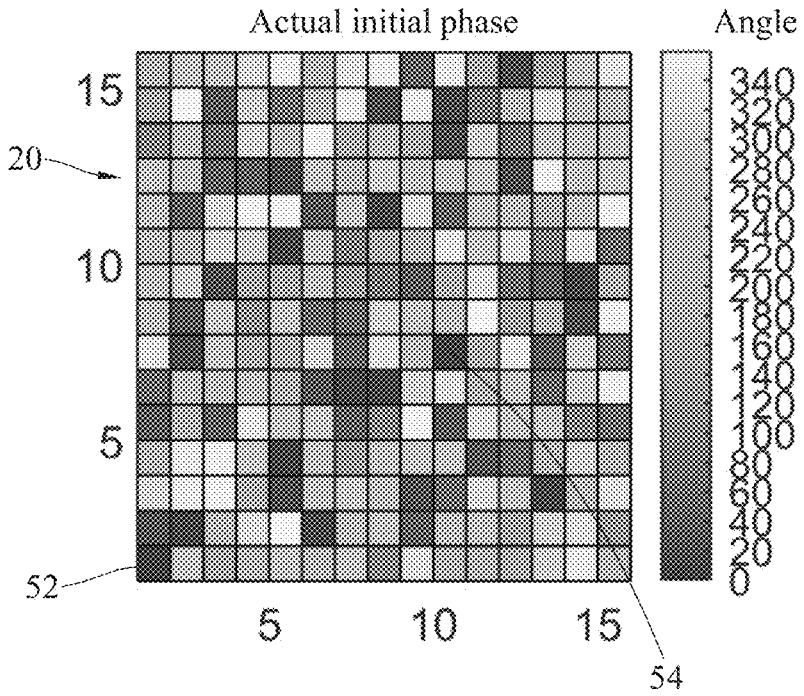
FIG. 5A is a schematic view of an actual initial phase of a 16×16 antenna array.
Figure 5B:
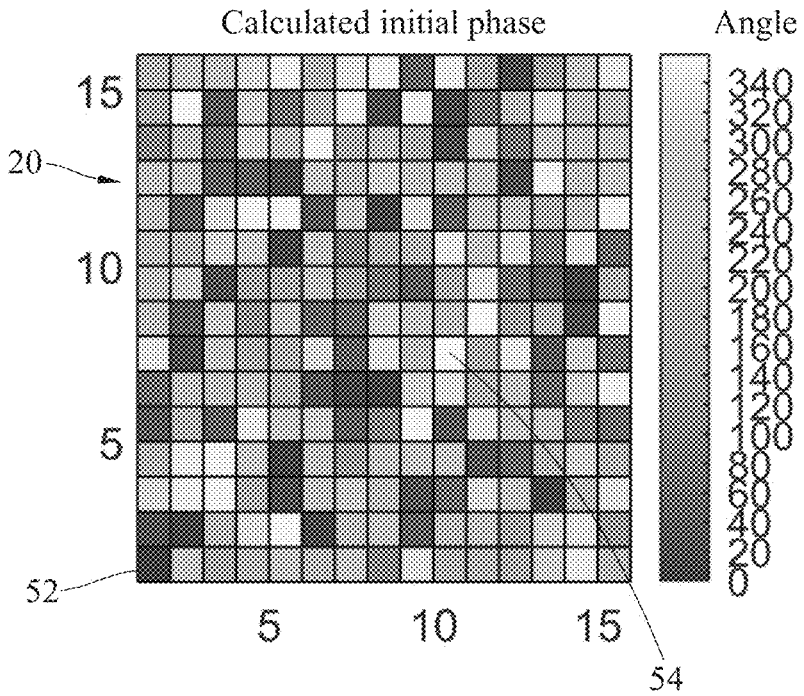
FIG. 5B is a schematic view of a calculated initial phase of the 16×16 antenna array of FIG. 5A according to another embodiment of the present invention.
Figure 5C:
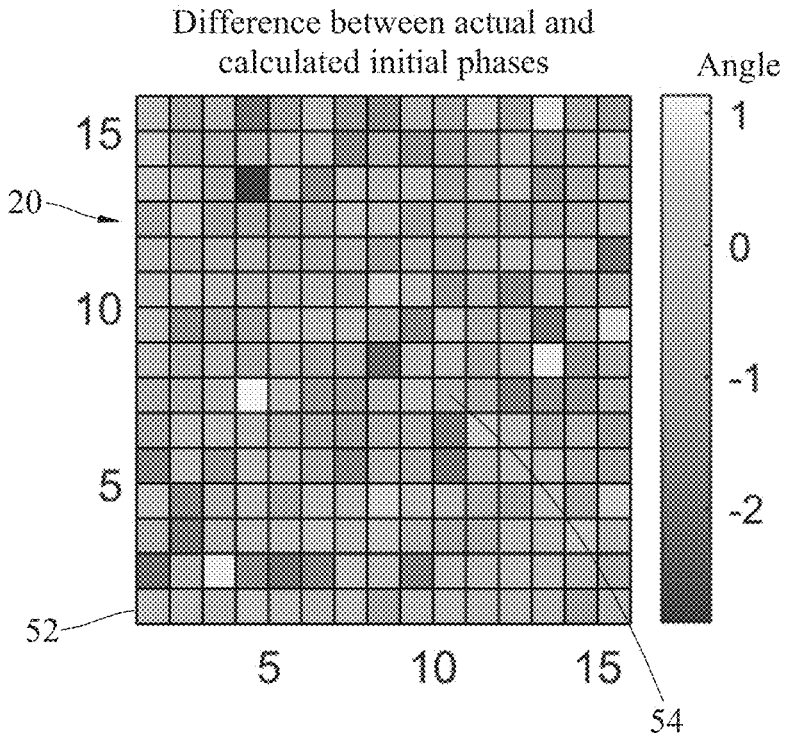
FIG. 5C is a schematic view of the phase difference between FIG. 5A and FIG. 5B.
Figure 5D:
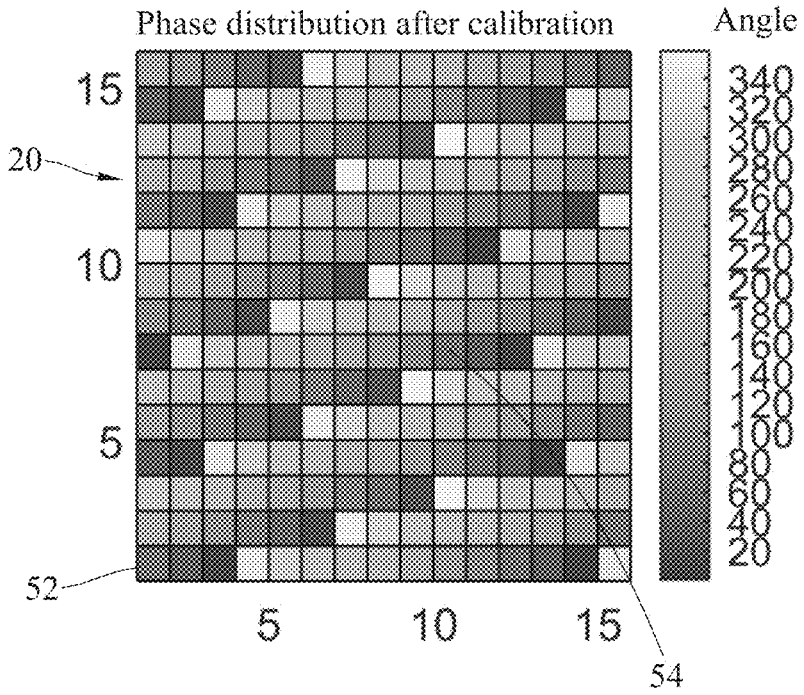
FIG. 5D is a schematic view of the phase distribution of the calculated phase of the 16×16 antenna array of FIG. 5A according to another embodiment of the present invention.

Refer to FIG. 5A, FIG. 5B, FIG. 5C and FIG. 5D. FIG. 5A to FIG. 5D are the phase values of each antenna of a 16×16 antenna array. FIG. 5A is a schematic view of an actual initial phase of a 16×16 antenna array. FIG. 5B is a schematic view of a calculated initial phase of the 16×16 antenna array of FIG. 5A according to another embodiment of the present invention. FIG. 5C is a schematic view of the phase difference between FIG. 5A and FIG. 5B. FIG. 5D is a schematic view of the phase distribution of the calculated phase of the 16×16 antenna array of FIG. 5A according to another embodiment of the present invention.

In an embodiment, as illustrated in FIG. 5A, there is an antenna array 20 as an example. The above-mentioned antenna array 20 is composed of 256 (16×16) antennas 22. Because each antenna 22 has a different initial phase, it is expressed in different gray scales, for example, both a first antenna 52 and a second antenna 54 have a random initial phase of 0 degrees as the same gray scale.

Regarding the Rotating Element Electric Field Vector (REV) method, since the power total of the antenna array 20 and the cosine variation of the phase of the phase shifters 24 of the antennas 22 is in consistency, it can be used to adjust the phase of the phase shifter 24 of each antenna 22 sequentially, in order to obtain the cosine curve of the power total difference, and calculate the initial phase and initial amplitude of each antenna 22 as a basis for calibration. Take a 5-bit digital phase shifter as an example, it requires changing the phase of each antenna 32 times and measuring the power total of the antenna array 32 times by using the Rotating Element Electric Field Vector (REV) method. As to the antenna array 20 composed of 256 (16×16) antennas 22, it requires performing phase modulation and power measurements 8192 (256×32) times.

In an embodiment, as illustrated in FIG. 5B, according to the present invention implemented in an antenna array 20 composed of 256 (16×16) antennas 22, it only requires to calculate at least 512 (256×2) times about phase modulations and power measurements by using the above-mentioned simultaneous equation of amplitudes and phases. This fast calibration not only greatly reduces the time-consuming of calibration of the antenna array 20, but improves its performance. For example, the initial phase calculated by the first antenna 52 according to another embodiment of the present invention is close to 0 degrees, and the initial phase calculated by the second antenna 54 according to another embodiment of the present invention is close to 359 degrees.

In an embodiment, as illustrated in FIG. 5C, the actual initial phase shown in FIG. 5A and the initial phase calculated according to another embodiment of the present invention shown in FIG. 5B have a phase error. For example, the phase error obtained by the first antenna 52 is close to 0 degrees, and the phase error obtained by the second antenna 54 is close to −1 degree.

In an embodiment, as illustrated in FIG. 5D, according to the result of the simultaneous equation of amplitudes and phases calculated by the processor 40, the controller 30 adjusts the phase shifter 24 of each antenna 22 for calibration. For example, with the aid of the phase distribution of the antenna array 20 after calibration in FIG. 5D, the main beam A (see FIG. 1 and FIG. 6) of the antenna array 20 can reach a predetermined target angle (such as 41.05 degrees), wherein the phase of the first antenna 52 after calibration according to another embodiment of the present invention is close to 60 degrees, and the phase of the second antenna 54 after calibration according to another embodiment of the present invention is close to 60 degrees.

Figure 6:
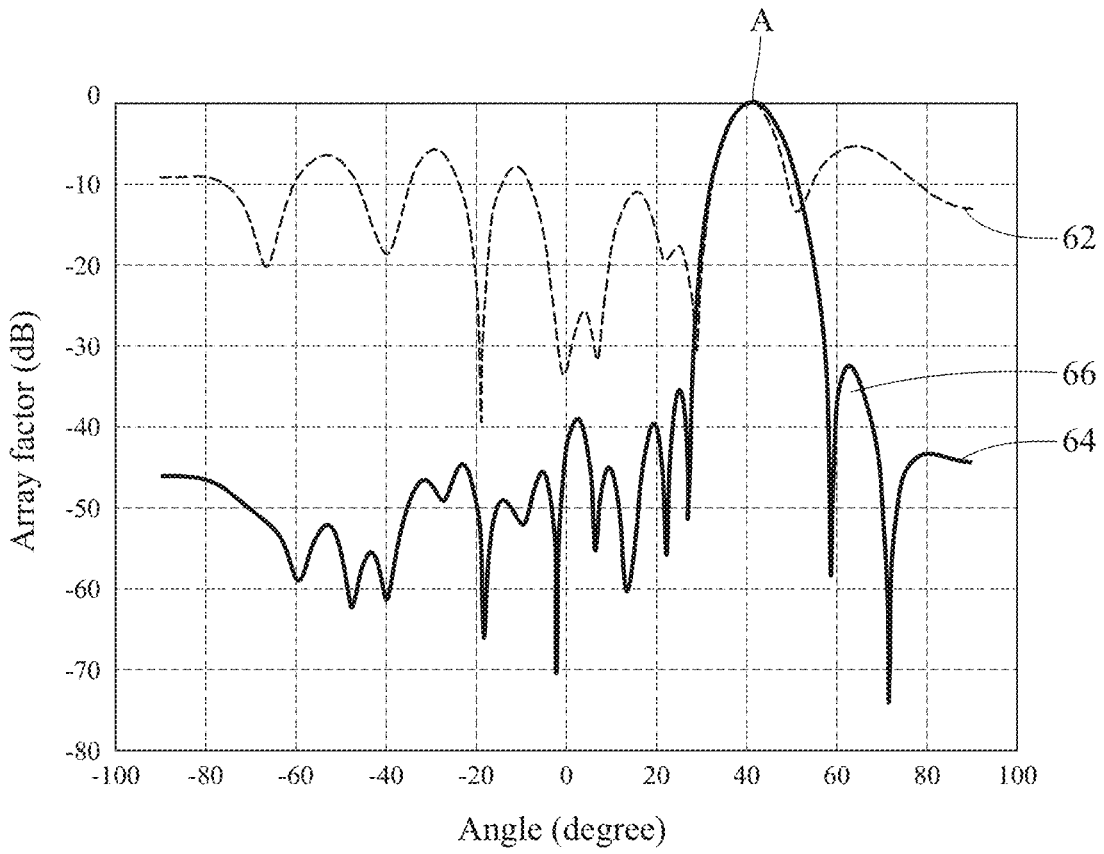
FIG. 6 is a schematic view of the phase difference between before and after calibration according to another embodiment of the present invention.

Refer to FIG. 6, FIG. 6 is a schematic view of the phase difference between before and after calibration according to another embodiment of the present invention.

In an embodiment, as illustrated in FIG. 6, the X-axis is the beam angle of the antenna array 20, and the Y-axis is the size of the array factor in dB. In an embodiment, the beam before calibration 62 of the antenna array 20 composed of 256 (16×16) antennas 22 which shown in FIG. 5A to FIG. 5D is shown by the dotted line in FIG. 6. In order to make the main beam A reach a predetermined target angle (such as 41.05 degrees), the controller 30 adjusts the angle of the phase shifter 24 of each antenna 22, and adjusts the attenuator 26 of each antenna 22 at the same time according to the condition that is the side lobe level −30 dB. The beam after calibration 64 of the antenna array 20 is shown by the solid line in FIG. 6, and the corrected beam 64 can have a maximum side lobe 66, which is a specification below −30 dB. The above-mentioned side lobe setting to −30 dB is for illustrative purposes only, rather than limiting the scope of the present invention.

The present invention can adjust the phase difference, amplitude difference of each antenna in any antenna array, and the power total of the antenna array for the antenna array to obtain a real number solution by the simultaneous equation of amplitudes and phases, which is the initial amplitude and initial phase of each antenna. It can be used to quickly calibrate the antenna array. If it cannot obtain a real number solution by the simultaneous equation of amplitudes and phases, the present invention can re-adjust the phase of each antenna in the antenna array again to another random angle until it is a real number solution by the simultaneous equation of amplitudes and phases. As a result, the efficiency of the calibrating antenna can be greatly improved. In other words, the present invention can properly calibrate the antenna array with lower operation complexity.

What is claimed is:

1. An antenna array calibration device, applied to an antenna array comprising a plurality of antennas, the antenna array calibration device comprises:

a processor, configured to analyze and calculate whether is a real number solution of a simultaneous equation of amplitudes and phases; and a controller, configured to adjust the antennas from having an initial phase to having a random phase, and adjust the antennas from having an initial amplitude to having a maximum amplitude;

wherein the processor calculates a phase difference by subtracting one of the initial phase and the random phase from the other, calculates an amplitude difference by subtracting one of the initial amplitude and the maximum amplitude from the other, and introduces the phase difference, the amplitude difference and a power total of the antenna array into the simultaneous equation of amplitudes and phases;

if there is a real number solution for the simultaneous equation of amplitudes and phases, the controller obtains initial amplitudes and initial phases of the antennas to calibrate the phase of the antenna array; and if there is no real number solution for the simultaneous equation of amplitudes and phases, the controller adjusts the antennas to having another random phase different from the random phase, and the processor recalculates the simultaneous equation of amplitudes and phases according to the other random phase in order to obtain a real number solution.

2. The antenna array calibration device according to claim 1, further comprising a plurality of phase shifters and a plurality of active components, wherein each of the antennas is coupled to a corresponding phase shifter among the phase shifters and to a corresponding active component among the active components.

3. The antenna array calibration device according to claim 2, wherein the controller controls the phase shifters to adjust the antennas from having the initial phase to having the random phase.

4. The antenna array calibration device according to claim 2, wherein the controller controls the phase shifters to adjust the antennas to having the other random phase different from the random phase.

5. The antenna array calibration device according to claim 2, wherein the controller controls the active components to adjust the antennas from having the initial amplitude to having the maximum amplitude.

6. The antenna array calibration device according to claim 2, wherein the active components further comprises: at least one of a digital attenuator, an analog attenuator, an amplifier and a variable gain amplifier (VGA).

7. The antenna array calibration device according to claim 2, wherein the antennas are one-dimensionally or two-dimensionally arranged in the antenna array.

8. An antenna array calibration method, applied to an antenna array, wherein the antenna array is composed of a plurality of antennas, a plurality of phase shifters and a plurality of active components, each of the antennas is coupled to a corresponding phase shifter among the phase shifters and to a corresponding active component among the active components, and the antenna array calibration method comprises:

measuring a power total of the antenna array;

controlling the active components to adjust the antennas from having an initial amplitude to having a maximum amplitude;

controlling the phase shifters to adjust the antennas from having an initial phase to having a random phase;

calculating a phase difference by subtracting one of the initial phase and the random phase from the other, calculating an amplitude by subtracting one of the initial amplitude and the maximum amplitude from the other, introducing the phase difference, an amplitude difference and the power total of the antenna array into a simultaneous equation of amplitudes and phases in order to calculate whether there is a real number solution for the simultaneous equation of amplitudes and phases;

if there is a real number solution for the simultaneous equation of amplitudes and phases, obtaining initial amplitudes and initial phases of the antennas to calibrate the phase of the antenna array; and if there is no real number solution for the simultaneous equation of amplitudes and phases, controlling the phase shifters to adjust the antennas to having another random phase different from the random phase, and recalculating the simultaneous equation of amplitudes and phases according to the other random phase in order to obtain a real number solution.

9. The antenna array calibration method according to claim 8, wherein the active components further comprises: at least one of a digital attenuator, an analog attenuator, an amplifier and a variable gain amplifier (VGA).

10. The antenna array calibration method according to claim 8, wherein the antennas are one-dimensionally or two-dimensionally arranged in the antenna array.

* * * * *